US006508715B1

(12) United States Patent
Jensen

(10) Patent No.: US 6,508,715 B1
(45) Date of Patent: Jan. 21, 2003

(54) NAIL MACHINE, AND A TOOL RING AND FITTING FOR SECURING HOLDING JAWS FOR SUCH MACHINE

(75) Inventor: Jøn Boie Jensen, Ebeltoft (DK)

(73) Assignee: Enkotec A/S, Skanderborg (DK)

( * ) Notice: Subject to any disclaimer, the term of this patent is extended or adjusted under 35 U.S.C. 154(b) by 0 days.

(21) Appl. No.: 09/831,530

(22) PCT Filed: Dec. 9, 1999

(86) PCT No.: PCT/DK99/00691

§ 371 (c)(1),
(2), (4) Date: Jun. 20, 2001

(87) PCT Pub. No.: WO00/37195

PCT Pub. Date: Jun. 29, 2000

(30) Foreign Application Priority Data

Dec. 10, 1998 (DK) ..... 1998 01634

(51) Int. Cl.[7] ..... B21G 3/00

(52) U.S. Cl. ..... 470/129; 470/121; 470/177; 470/179

(58) Field of Search ..... 470/57, 110, 120, 470/121, 129, 140, 154, 156, 177, 179; 198/384, 397.02, 470.1, 474.1

(56) References Cited

U.S. PATENT DOCUMENTS 2,917,756 A 12/1959 Stearns et al.
5,081,732 A * 1/1992 Steinhilber ..... 470/129
5,651,739 A * 7/1997 Carlsen ..... 470/129
5,833,543 A * 11/1998 Yang ..... 470/60

FOREIGN PATENT DOCUMENTS

| | | |
|---|---|---|
| DK | 143935 | 11/1981 |
| EP | 0414670 | 3/1993 |
| SU | 379119 | 6/1986 |
| SU | 1645056 | 4/1991 |
| WO | 8903734 | 5/1989 |

OTHER PUBLICATIONS

SU 379119 A (Forge Press Equip) Jun. 30, 1986 (Abstract) World Patents Index (Online).
London U.K.:Derwent . . . Ltd. (Retrived On Mar. 07, 2000). Retrieved From . . . DW198704.
SU 1645056 A (Forge Press WKS) Apr. 30, 1991 (Abstract) World Patents Publications, Ltd.
Ltd. (Retrieved on Mar. 07, 2000). Retrieved From EPO WPI Data Base. DW1992213.

* cited by examiner

*Primary Examiner*—Ed Tolan
(74) *Attorney, Agent, or Firm*—Ladas & Parry

(57) ABSTRACT

A fitting for the tool ring in a nail machine, or a tool ring, said fitting having means for receiving and securing at least one holding jaw in the fitting, and a support face that enables the fitting to abut on a support face which is complementary to the support face of the fitting; and means for clamping the fitting onto the complementary support face; and wherein the fitting has at least one clamp face which is arranged opposite the support face; and wherein the means for clamping the fitting on the tool ring comprise a first element configured for abutment on the clamp face and past the support face and for engaging with an element on a tool ring included therefor.

15 Claims, 7 Drawing Sheets

NAIL MACHINE, AND A TOOL RING AND FITTING FOR SECURING HOLDING JAWS FOR SUCH MACHINE

This application is a 35 USC 371 of PCT/DK99/00691 filed Dec. 9, 1999.

The present invention relates to nail machines, and a roller ring and a fitting for such nail machine.

For instance, EP patent No 414 670 discloses state of the art nail machines for manufacturing elongate bodies with heads, such as nails, screws, tacks and other elongate bodies with heads, wherein the machine has a cutting station for cutting off individual pieces of wire that are subsequently received in a roller device that comprises a tool ring, said tool ring having an axis of rotation where about the tool ring can be caused to rotate; an outer and an inner surface that faces away from and towards, respectively, the axis of rotation of the tool ring, and a surface which is substantially perpendicular relative to the axis of rotation; and wherein the tool ring further comprises a plurality of holding jaws and means for positioning and securing the holding jaws at a mutual distance along the circumference of the tool ring; and wherein each holding jaw has a groove for receiving an elongate body longitudinally of said groove whereby the holding jaw is caused to serve as clamp jaw for securing and positioning the elongate body.

Hereby the holding jaw is able to contribute to securing the cut-off length of wire in order to enable that a head is rolled there onto, the holding jaw being configured such that the head is rolled out in a cavity configured on said holding tray.

The tool ring in these machines being configured for rotating about said axis of rotation, it is enabled that a continuous process is accomplished in which a plurality of holding jaws sequentially pass the point where the lengths of wire are cut off to enable that each cut-off length of wire is introduced into a holding jaw following which the holding jaw is displaced away from the cutting station and towards the roller station where the head is rolled onto the cut-off length of wire. Obviously, in order to achieve a high productivity for the machine such machines receive many lengths of wire per time unit, and this presupposes that the tool ring rotates at a relatively high rate of rotation. This means that it is extremely important that the individual holding jaws are very accurately situated along the circumference of the tool ring.

Besides, it is obvious that the holding jaws are secured effectively so as to prevent them from breaking loose and displacing in particular during the rolling process.

In the prior art machine this problem has been solved in that the tool ring is provided with a substantially cylindrical and radially inwardly oriented surface on the tool ring; and wherein the inwardly oriented surface is provided with a plurality of holding jaws and a corresponding number of wedge-shaped spacer blocks that are secured in firm abutment on the inwardly oriented surface by means of one or more machine bolts that are screwed into the tool ring. By this solution a holding jaw and a spacer block are thus alternatingly arranged until the entire above-mentioned, inwardly oriented surface is covered with holding jaws and spacer blocks that abut on each other. When the spacer blocks are subsequently clamped against the tool ring, the above-described wedge-shape of the spacer blocks causes the holding jaws to be wedged firmly between the spacer blocks, and by loosening and securing, respectively, the individual spacer blocks it is possible to regulate the mutual distance between the holding trays.

However, it is a problem in connection with this type of machine that the above-mentioned clamping process is very time-consuming, and that in practice it can only be performed to standard by an operator having considerable experience. Besides, provided a single block or holding jaw is loosened, crushed or deformed during use of the machine, this may entail that all the spacer blocks and holding jaws configured in the tool ring must subsequently be adjusted following attachment or securing of the loose or destroyed spacer block or holding tray.

Additionally, an alternative type of machine is known wherein the tool ring comprises a plurality of apertures in which a corresponding number of holding jaws can be configured that are each attached by means of a wedge-shape sleeve that extends around each holding tray, and wherein means are configured for displacing the wedges-shaped sleeve downwards into the apertures configured in the tool ring in such a manner that the holding jaw is wedged firmly into the aperture along with the wedges-shaped sleeve. It is a problem of such machines, however, that the clamping of the holding jaws into the tool ring can entail deformations in the tool ring proper as a consequence of the wedging-in of the individual holding tray, which means that in this case, too, it is necessary to carry out a very accurate clamping of the individual holding tray, in order to ensure the best possible quality of the manufacture of the individual nails, screws, tacks and the like objects.

In the light of this, it is the object of the present invention to provide a machine whereby said drawbacks are fully or partially remedied.

In accordance with the invention, this is obtained in that the means for positioning and securing the holding jaws on the tool ring comprises a plurality of fittings that are removable from the tool ring, each of said fittings having means for receiving and securing at least one holding jaw in the fitting, and a support face that allows the fitting to abut on a support face that is complementary to the support face of the fitting, and which is configured on one of said surfaces on the tool ring; and means for clamping the fitting on the tool ring and wherein the fitting has at least one clamp surface which is opposite the support face; and wherein the means for clamping the fitting on the tool ring comprises a first element that abuts on the clamp face of the fitting and a second element that extends from the clamp face past the support face and engages with the tool ring.

Hereby it is indeed ensured that the forces necessary to ensure effective attachment of the individual jaws are, to the widest extent possible, received within the separate fitting itself, and that therefore these forces are not to a substantial extent transmitted as flexural forces to the tool ring.

Besides, the clamping itself and the mounting of the individual fittings make smaller requirements to the operator, since individual fittings and associated holding jaws can be replaced individually without thereby necessitating adjustment of the remaining holding trays, and since small variations in the clamping force have only a marginal bearing on the flexing of the tool ring.

The support face on the fitting and the complementary support face on the tool ring can, in a preferred embodiment of the invention, be configured such that—following mounting of the fitting on the tool ring—the fitting extends completely outside the surface of the tool ring on which the fitting is mounted.

Additionally, the tool ring and the fitting can advantageously have complementary guide faces that ensure correct positioning of the fitting when being mounted on the tool ring.

In a preferred embodiment of a nail machine according to the invention, such machine comprises two tool rings arranged opposite each other in such a manner that their respective axes of rotation intersect at a blunt angle so as to cause two opposed holding jaws on the two tool rings to be pressed against each other along only a part of the periphery of the tool ring.

According to a particularly preferred embodiment of the invention whereby a particularly simple mounting of the individual fitting is obtained, the means for clamping the fittings onto the tool ring comprise a number of machine bolts; and wherein mounting apertures are provided at the complementary support faces on the tool ring, said mounting apertures being configured with a view to introduction of a machine bolt for securing the fitting onto the tool ring; and wherein the mounting aperture extends substantially perpendicular to the complementary support face on the tool ring. In this context the fitting advantageously comprises mounting apertures for insertion of the machine bolt, said mounting apertures extending through the fitting and substantially perpendicular to the support face of the fitting, and is arranged such that they correspond to the mounting apertures on the tool ring to allow a machine bolt to be inserted through each mounting aperture in the fitting, and into the corresponding mounting aperture on the tool ring, whereby the support face of the fitting is urged towards the corresponding complementary support face on the tool ring following mounting of the fitting thereon.

According to a further preferred embodiment of the invention, the fitting comprises at least two clamp faces that face each other, and means for shifting the two clamp faces towards each other in such a manner that a holding jaw can be clamped between the two clamp faces; and wherein the fitting is configured as a yoke with two legs and a spacer element that extends between the two legs; and wherein the clamp faces are situated at the end of each leg in such a manner that a tractive force occurs in the spacer element upon clamping of a holding jaw between the clamp faces.

In this context, the support face of the fitting can conveniently be located on the spacer element.

Besides, the clamp faces can conveniently be situated on that side of the spacer element which is opposite the support face of the fitting, whereby the spacer element will—following mounting of the fitting—extend between the holding jaw and the complementary support face.

According to a preferred embodiment, the fitting is configured for receiving only one holding tray, and at least one of the legs on the fitting extends across the spacer element at a distance there from; and the mounting apertures comprise a mounting aperture for each leg, said mounting aperture extending through the leg as well as the spacer element whereby the leg that extends a distance from the spacer element is pressed in a direction towards the spacer element by clamping of the fitting; and wherein the two clamp faces converge towards each other in a direction away from the spacer element, whereby the holding jaw is clamped firmly between the two clamp faces upon attachment of the fitting onto the tool ring.

According to an alternative embodiment the fitting can advantageously be configured for receiving two or more holding trays, and wherein the fitting comprises a number of loose clamp blocks that each has two oppositely oriented clamp faces, said loose clamp blocks being configured such that they can be positioned between the legs on the yoke in such a manner that, between the clamp blocks and between the clamp blocks and the legs on the yoke, a holding jaw can be received and attached.

The invention will now be described in further detail in the following and with reference to the drawings, wherein.

Figure 2:
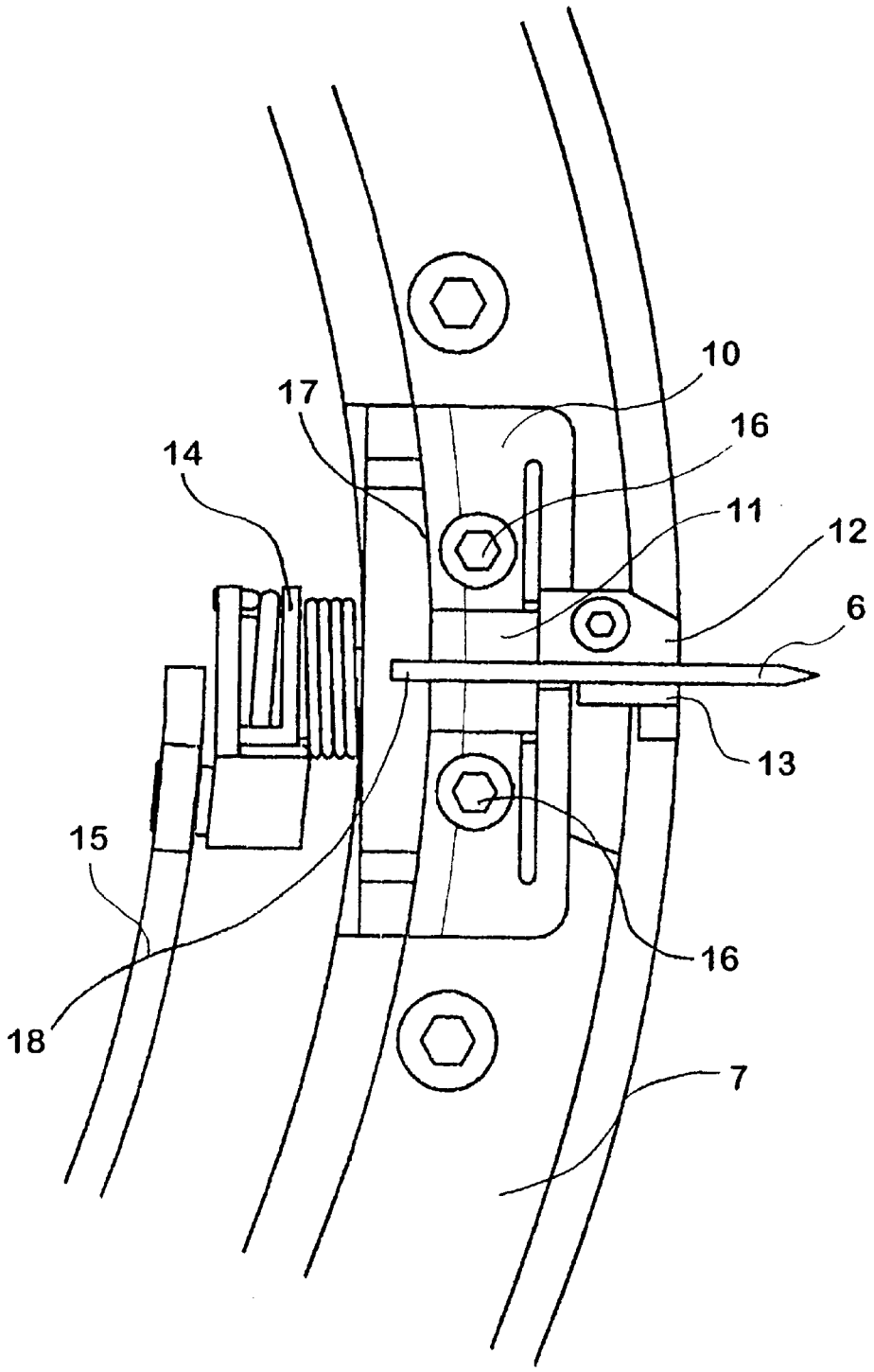
FIG. 2 is a sketch illustrating a section of a first embodiment of a tool ring with a fitting according to the invention, for a nail machine as shown in FIG. 1.
Figure 3C:
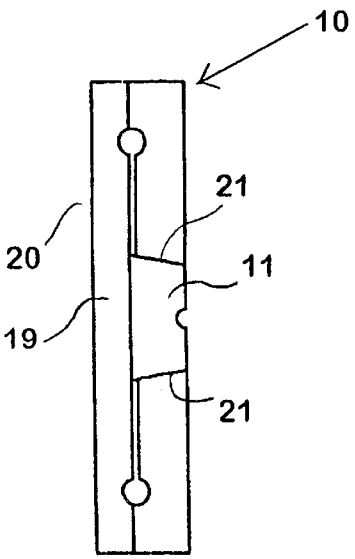
Figure 3B:
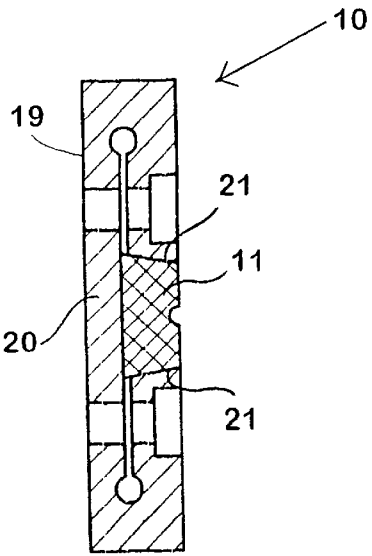
Figure 3D:
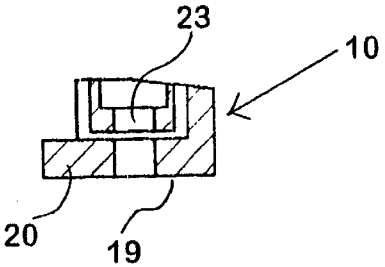
Figure 3A:
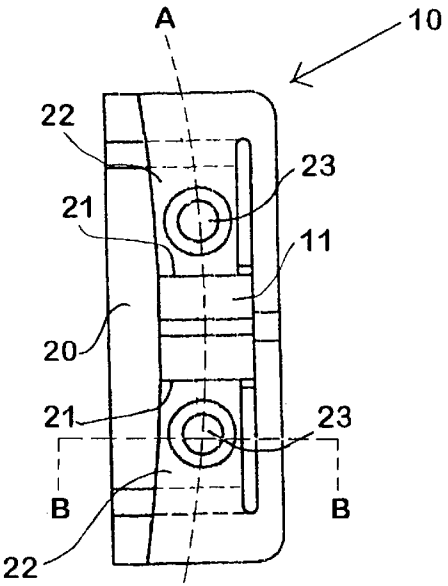

FIG. 3*a* is a top plan view of the fitting shown in FIG. 2;

FIG. 3*b* is a sectional view of the fitting shown in FIG. 3*a*, along the line A—A;

FIG. 3*c* is a lateral view of the fitting shown in FIGS. 3*a* and 3*b;*

Figure 4C:
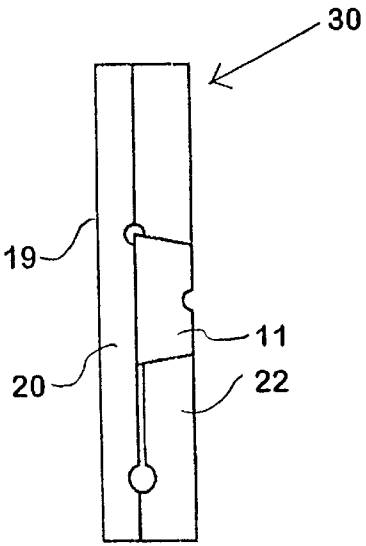
Figure 4B:
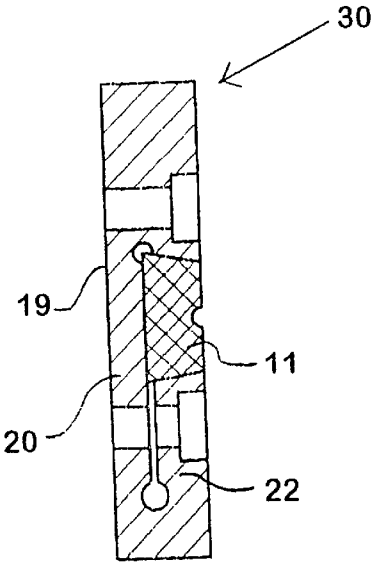
Figure 4D:
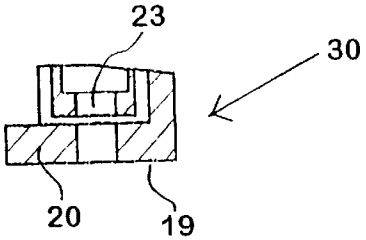
Figure 4A:
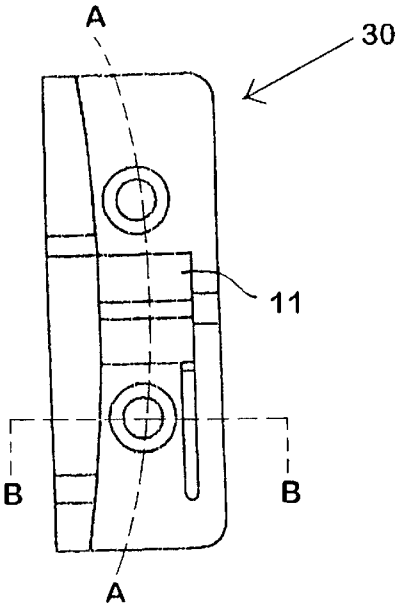

FIG. 3*d* is a sectional view of the fitting shown in FIGS. 3*a*, 3*b* and *c*, seen in a sectional view along the line B—B;

FIG. 4*a* is a top plan view of an alternative embodiment of a fitting according to the present invention;

FIG. 4*b* is a sectional view of the fitting shown in FIG. 4*a*, seen in a sectional view along the line A—A;

FIG. 4*c* is a lateral view of the fitting shown in FIGS. 4*a* and 4*b;*

Figure 5C:
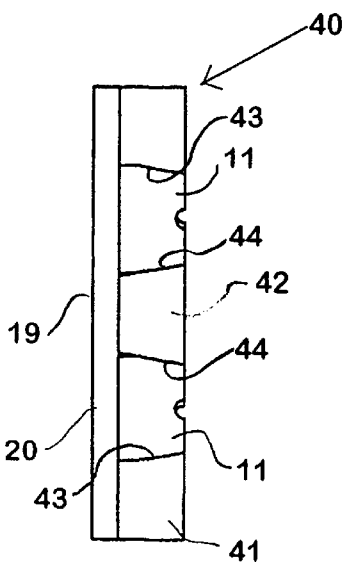
Figure 5B:
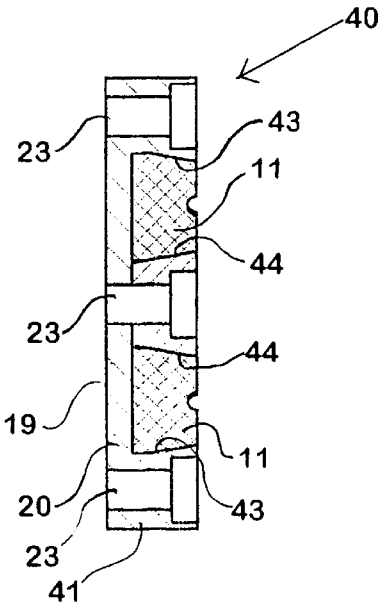
Figure 5D:
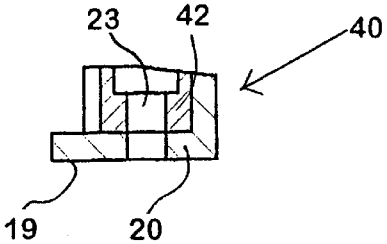
Figure 5A:
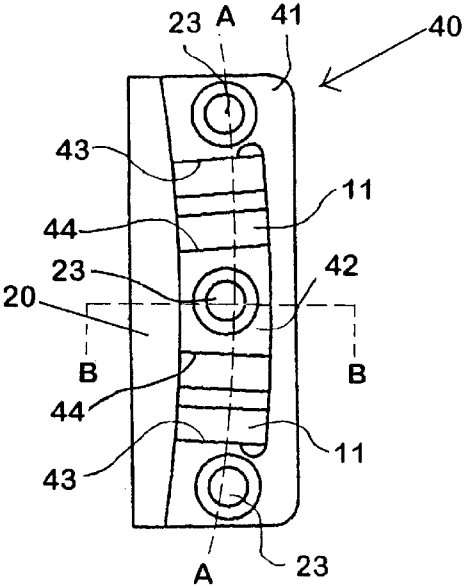

FIG. 4*d* is a sectional view of the fitting shown in FIGS. 4*a, b* and *c*, seen in a sectional view along the line B—B;

FIG. 5*a* is a top plan view of a second, alternative embodiment of a fitting according to the present invention;

FIG. 5*b* is a sectional view of the fitting shown in FIG. 5*a*, seen in a sectional view along the line A—A;

FIG. 5*c* is a lateral view of the fitting shown in FIGS. 5*a* and 5*b;*

Figure 1:
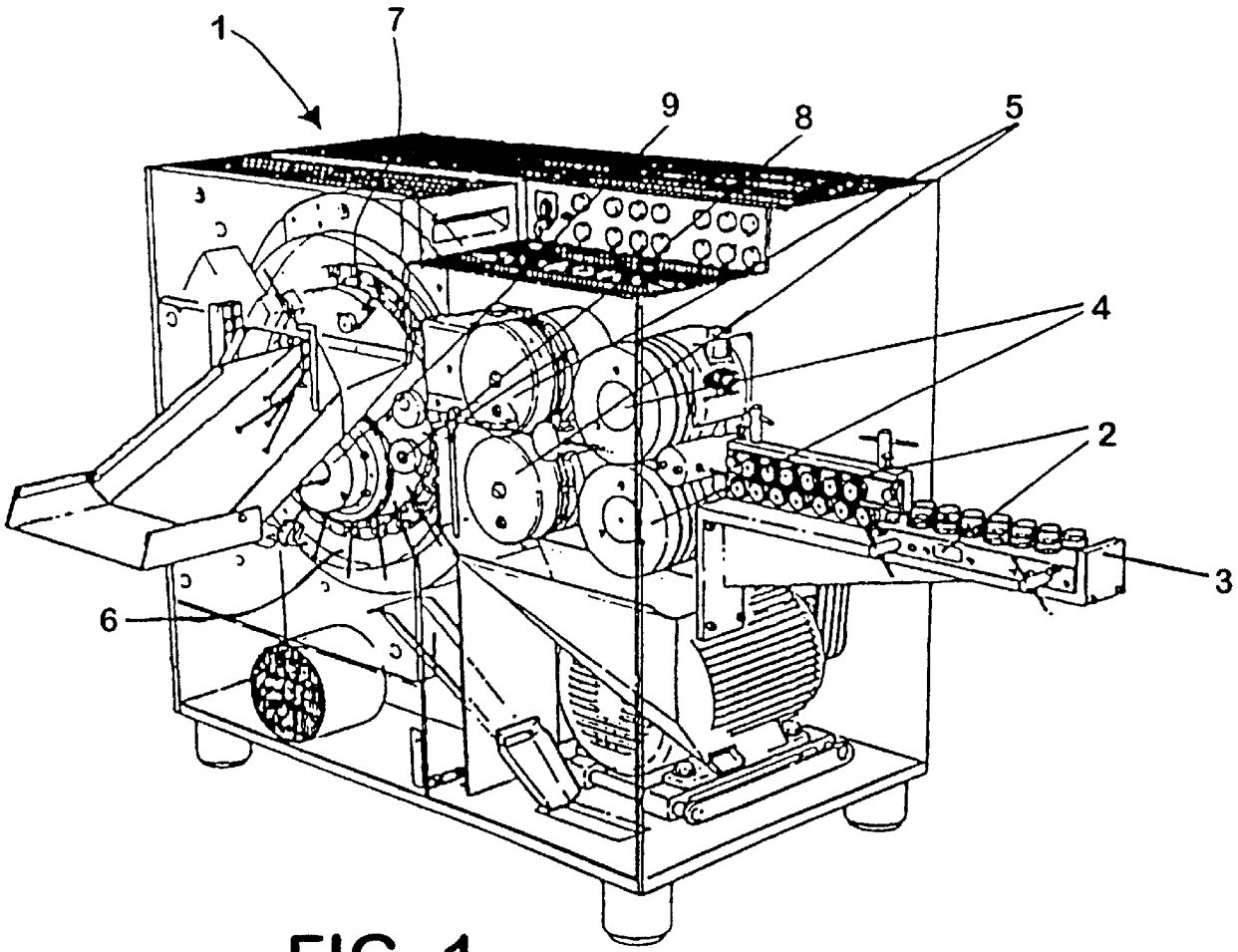
FIG. 1 is a perspective explanatory sketch showing a nail machine, whose principle is known, provided with a tool ring.
Figure 6:
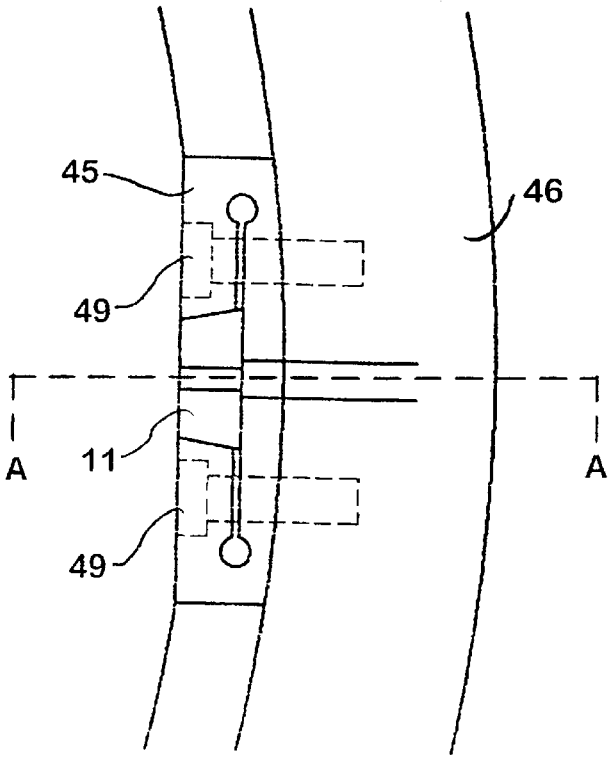
Figure 7:
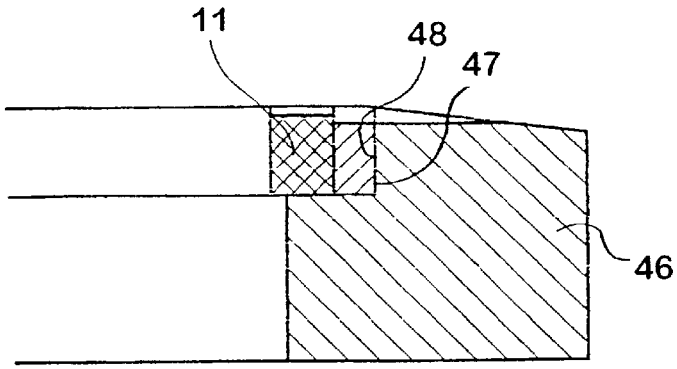
Figure 8:
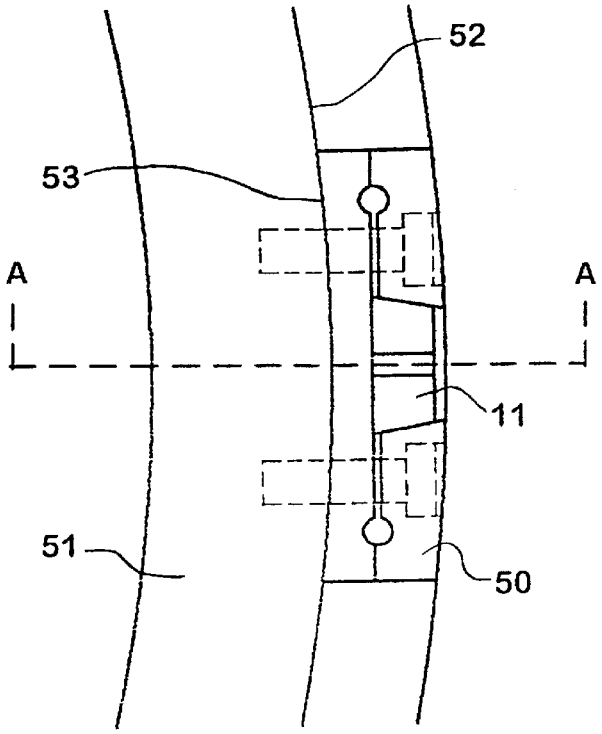
Figure 9:
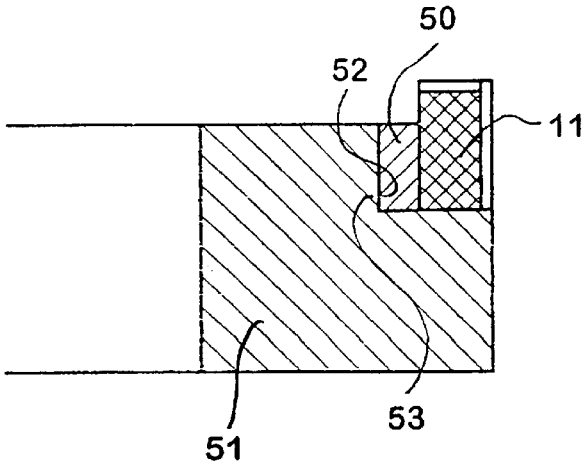

FIG. 5*d* is a sectional view of the fitting shown in FIGS. 5*a, b* and *c*, seen in a sectional view along the line B—B;

FIG. 6 is a top plan sketch of a section of a second embodiment of a tool ring with a fitting according to the invention for a nail machine according to FIG. 1;

FIG. 7 is a sectional view sketching the tool ring shown in FIG. 6 with fitting, seen in a sectional view along the line A—A shown in FIG. 6;

FIG. 8 is a top plan sketch of a section of a third embodiment of a tool ring with a fitting according to the invention for a nail machine according to FIG. 1; and FIG. 9 is a sectional view sketching the tool ring shown in FIG. 8 with fitting, seen in a sectional view along the line A—A shown in FIG. 8.

Thus, FIG. 1 illustrates a nail machine 1 that comprises a stretching station 2, through which a metal wire 3 is pulled by means of an arrangement of drive rollers 4 from a not shown coil of wire, and wherein the metal wire 3 is straightened thereby and stretched to a substantially completely straightened piece of wire. After the drive rollers 4, the metal wire 3 is displaced to pass through a wire cutter consisting of two rotating wire cutters 5, and from the rotating wire cutters 5 the pieces of wire 6 cut off from the wire 3 are inserted into a tool ring 7 that rotates clockwise in the embodiment shown herein. The individual lengths of wire 6 can be locked and positioned by means of a roller 8 intended therefore whereby the lengths of wire 6 extend equal distances towards the center of the tool ring. At the bottom-most area of the tool ring, a roller 9 is arranged that is configured to cooperate with the tool ring 7 to roll heads onto the individual lengths of wire 6. Then the lengths of wire 6 provided with heads are conveyed on in the tool ring and upwards to the topmost part of the tool ring 7 where the length of wire provided with head is let go by the tool ring and drops onto a chute 10 whereby the length of wire is removed from the nail machine.

The above-mentioned machine and its functionality are in principle commonly known; and for that reason they are not subject to specifications herein. However, the present invention specifically relates to the tool ring, of which there are usually two in such nail machine, which two tool rings are arranged opposite each other in such a manner that they are able to rotate synchronously about their axes of rotation that usually intersect in an blunt angle. Hereby it is enabled that the individual cut-off lengths of wire 6 can be clamped between the two tool rings along a minor part of the periphery of the tool ring which is subject to a very high abutment pressure, whereby it is ensured that the piece of wire is firmly locked during the rolling procedure proper.

Along the periphery of the tool ring, a row of holding jaws is arranged wherein the jaws are usually made of a very hard and wear-resistant metal. Such holding jaws are provided with a groove for receiving and securing the individual lengths of wire 6, and besides the holding jaws have, at the groove, a cavity in which the length of wire is deformed plastically, in such a manner that the cavity defines the shape of the underside of the head rolled onto the length of wire 6.

Thus, these holding jaws are exposed to very powerful forces and to a high degree subject to wear, and therefore they are, as mentioned above, made of a very hard and wear-resistant material. Due to the fact that the holding jaws must be able to seize and firmly lock the individual cut-off lengths of wire 6 with a very high degree of accuracy, it is very important that the holding jaws are positioned correctly along the periphery of the tool ring.

Thus, FIG. 2 is a sectional view of a tool ring 7 according to the invention, said tool ring 7 being provided with a fitting 10 in which a holding jaw 11 is mounted. Besides, the figure also illustrates how a piece of wire 6 rests in the holding jaw 11, and that a seizing mechanism is arranged that comprises a fixated holding jaw 12 and a movable holding jaw 13 that can, by means of a spring-biased movement mechanism 14 and a cam 15 that is fixated relative to the frame of the nail machine, be moved for attachment and release of the piece of wire 6.

According to the invention the fitting 10 is releasably mounted on the tool ring 7 by means of two bolts 16, and the fitting 10 and the holding jaw 11 thereby form a roller surface 17, so as to ensure that the innermost end 18 of the piece of wire 6 is, by means of the roller 9 shown in FIG. 1, rolled across the roller surface 17.

Now, FIGS. 3*a, b, c* and *d* illustrate in detail the fitting 10 shown in FIG. 2 comprising the holding jaw having the fitting 10 mounted therein. As shown in this embodiment the fitting 10 is configured with a substantially plane support face 19 which is, following mounting on the tool ring 7 shown in FIG. 2, in abutment on a complementarily configured support face on the tool ring 7. Besides, the fitting 10 is configured as a yoke that comprises a bottom portion 20 on which the support face 19 is configured. Op top of the bottom part 20, the holding jaw 11 is arranged between two clamp faces 2 that are configured on a pair of elastic legs 22 that extend to both sides of the holding trays, and is at its most distal end relative to the holding jaw secured to the bottom part 20 on the fitting 10. As will appear, apertures 23 are configured for insertion of bolts 16 as shown in FIG. 2, said bolts 16 thereby causing both that the fitting 10 can be attached to the tool ring 7, and that the holding jaw 11 is clamped firmly in the fitting between the two clamp faces 21 on the elastic legs 22.

It will appear that, due to the structure of the fitting 10, the fitting 10 will, upon mounting thereof on the tool ring 7, transmit relatively small flexural forces to the tool ring 7.

Now, FIGS. 4*a, b, c* and *d* illustrate an alternative embodiment of a fitting 30 for a tool ring according to the present invention, said fitting 30 corresponding exactly to the one shown in FIGS. 3*a, b, c* and *d*; and therefore this figure uses essentially the same reference numerals.

The fitting shown in FIGS. 4*a, b, c* and *d*, however, have the one difference that one of the elastic legs shown in FIGS. 3*a, b, c* and *d* is configured to be inelastic as an integral part of the bottom portion 20 whereby it is ensured that a more exact positioning of the holding jaw 11 is obtained relative to the fitting 30.

Now, FIGS. 5*a, b, c* and *d* illustrate a further alternative embodiment of a fitting 40 according to the present invention, said fitting 40 distinguishing itself in being able to receive two holding jaws 11 in one and the same fitting. As shown, the fitting comprises two separate portions, a yoke-shaped bottom part 41 and a clamp block 42, but apart from that the fitting 40 corresponds to the ones shown in FIGS. 3*a, b, c* and *d*; and the fittings 10 and 30 shown in FIGS. 4*a, b, c* and *d*; the fitting 40 according to FIGS. 5*a, b, c* and *d* having a bottom portion 20 with a support face 19 and apertures 23 for receiving bolts for clamping the fitting firmly onto the tool ring 7 according to FIG. 2, and simultaneously for firmly clamping the holding jaws 11 in the fitting 40.

However, the yoke-shaped bottom part 41 is configured in such a manner that it forms two opposed clamp faces 43 that are fixated relative to the yoke-shaped bottom part 41, and wherein the clamp block 42 with opposed clamp faces 44 can be placed between the two clamp faces 43 on the yoke-shaped bottom part 41 in such a manner that each of the holding jaws 11 is firmly wedged between the clamp faces 43 on the yoke-shaped bottom part 41 and the clamp faces 44 on the clamp block 42, when the clamp block is firmly clamped by means of the bolting aperture 23 therein.

In this manner fittings can in principle be constructed that contain three and more holding jaws by establishment of a correspondingly larger number of clamp blocks. The very fact that the a fitting as shown is used for two holding jaws alone means that a very good positioning of the individual holding jaws is accomplished since they will always be positioned in stable abutment against the two permanent clamp faces 43 on the yoke-shaped bottom part 41.

Obviously the above-mentioned embodiments of fittings are not limiting for the liberty at which the fittings can be arranged on a tool ring.

Thus, FIGS. 6 and 7 illustrate an alternative positioning of the individual fittings on the tool ring, where FIG. 6 shows a section of a tool ring 46 provided with a fitting 45 and seen from above, from where it will appear that the fitting is secured radially towards the inside of the tool ring. FIG. 7 illustrates the embodiment shown in FIG. 6, seen in a sectional view along the line A—A in FIG. 6, from where it will appear that the fitting 45 has a support face 47 that abuts on the complementarily configured support face 48 on the tool ring 46, and is secured thereto by means of two bolts 49 as shown in FIG. 6. Hereby the bolts will, as shown in the preceding figures, both have the function of clamping the fitting 45 to the tool ring, and securing the holding jaw 11 in the fitting 45.

Now FIGS. 8 and 9 illustrate an alternative positioning of a fitting 50 according to the invention on a tool ring 51. From here it will appear that the fitting can be located and attached on surface of the tool ring 51 that is oriented radially outwards relative to the tool ring center, by the fitting 50 having a support face that is clamped towards the complementarily configured support face 52 on the tool ring 51.

In the same manner as shown in the embodiment illustrated in FIG. 2, the embodiments shown in FIGS. 6 through 9 bring about the advantages that a considerable amount of the forces required for ensuring the holding jaw 11 in the fitting 45,50 is received within the fitting 45,50 proper and thus only a marginal portion of these forces is transmitted to the tool ring 46,51 proper.

It will appear from this that the present invention can be exercised in a wide variety of ways apart from the above disclosures, while variations in the location and configuration of the individual fittings in accordance with the actual situation are perceivable.

What is claimed is:

1. A nail machine for the manufacture of heads on elongate bodies, including nails and screws, said machine comprising at least one tool ring having an axis of rotation about which the tool ring can be caused to rotate, an outer and an inner surface that face away from and towards, respectively, the axis of rotation of the tool ring, and a surface that is substantially perpendicular relative to the axis of rotation, and wherein the tool ring further comprises a plurality of holding jaws and means for positioning and securing the holding jaws at a mutual distance along the circumference of the tool ring, and wherein each holding jaw has a groove for receiving an elongate body longitudinally of the groove, whereby the holding jaw serves as clamp jaw for securing and positioning the elongate body, characterized in that the means for positioning and securing the holding jaws on the tool ring comprise a plurality of fittings that are releasable relative to the tool ring, each of said fittings having means for receiving and securing at least one holding jaw in the fitting, and a support face that allows the fitting to abut on a support face that is complementary to the support face of the fitting and configured on one of said surfaces on the tool ring, and means for securing the fitting on the tool ring, and wherein the fitting has at least one clamp face which is opposite the support face, and wherein the means for clamping the fitting onto the tool ring comprises a first element configured for abutment on the clamp face of the fitting, and a second element configured for extending from the clamp face and past the support face and engage with an element on the tool ring configured therefor.

2. A nail machine according to claim 1, characterized in that the support face on the fitting and the complementary support face on the tool ring are configured such that the fitting will, following mounting of the fitting on the tool ring, extend completely outside that surface on the tool ring on which the fitting is mounted.

3. A nail machine according to claim 1, characterized in that the tool ring and the fitting have complementary guide faces that ensure correct positioning of the fitting by mounting thereof on the tool ring.

4. A nail machine according claim 1, characterized in that the machine comprises two tool rings located opposite each other in such a manner that their respective axes of rotation intersect at a blunt angle in such a manner that opposed holding jaws on the two tool rings are pressed against each other only along a part of the tool ring peripheries.

5. A fitting for use in a machine or a tool ring in accordance with claim 1, characterized in that the fitting has means for receiving and securing at least one holding jaw in the fitting, and a support face that allows the fitting to abut on a support face which is complementary to the support face of the fitting, and means for clamping the fitting to the complementary support face; and wherein the fitting has at least one clamp face which is opposite the support face; and wherein the means for clamping the fitting on the tool ring comprise a first element configured for abutment on the clamp face of the fitting, and a second element configured for extending from the clamp face and past the support face and for engaging with an element on a tool ring intended therefor.

6. A fitting according to claim 5, characterized in that the fitting has to clamp faces that face towards each other; and that the fitting has means for displacing the two clamp faces towards each other in such a manner that a holding jaw can be firmly clamped between the two clamp faces; and wherein the fitting is configured as a yoke with two legs and a spacer element that extends between the two legs; and wherein the clamp faces are configured at the end of each their leg in such a manner that a tractive force is produced in the spacer element when a holding jaw is clamped between the clamp faces.

7. A fitting according to claim 5, characterized in that the support face of the fitting is configured on the spacer element.

8. A fitting according to claim 6, characterized in that the clamp faces are arranged on the side of the spacer element which is situated opposed the support face of the fitting, whereby the spacer element will, following mounting of the fitting, extend between the holding jaw and the complementary support face.

9. A fitting according to claim 5, characterized in that the fitting has mounting apertures for conveyance of a machine bolt, said mounting apertures extending through the fitting and substantially perpendicular to the support face of the fitting, and is arranged such that they correspond to the mounting apertures on the tool ring, thereby enabling that a machine bolt can be conveyed through each mounting aperture in the fitting and into the corresponding mounting aperture on the tool ring, so that the support face of the fitting is pressed against the corresponding complementary support face on the tool ring following mounting of the fitting thereon.

10. A fitting according to claim 8, characterized in that the fitting is configured for receiving only one holding tray; and in that the legs on the fitting extend across the spacer element at a distance there from; and in that the mounting apertures comprise one mounting aperture for each leg, said mounting aperture extending through the leg as well as the spacer element in such a manner that the leg is pressed in a direction towards the spacer element by clamping of the fitting; and wherein the two clamp faces converge mutually in a direction away from the spacer element.

11. A fitting according to claim 8, characterized in that the fitting is configured for receiving two or more holding trays; and that the fitting comprises a number of loose clamp blocks that each has two clamp faces that face away from each other, said loose clamp blocks being configured such that they can be arranged between the legs on the yoke so as to enable that, between the clamp blocks and between the clamp blocks and the legs of the yoke, a holding jaw can be received and clamped.

12. A tool ring for securing preferably elongate bodies in a machine for the manufacture of heads on elongate bodies, including nails and screws, said tool ring having an axis of rotation about which the tool ring can be caused to rotate, an outer and an inner surface that face away from and towards the axis of rotation, and a surface which is substantially perpendicular relative to the axis of rotation, and wherein the tool ring further comprises a plurality of holding trays, and means for positioning and securing the holding jaws at a mutual distance along the tool ring periphery, and wherein each holding jaw has a groove for receiving an elongate body longitudinally of the groove whereby the holding jaw serves as clamp jaw for securing and positioning the elongate body, characterized in that the means for positioning and securing the holding jaws on the tool ring comprise a plurality of fittings that are releasable relative to the tool ring, said fittings each having means for receiving and securing at least one holding jaw in the fitting, and a support face that allows the fitting to abut on a support face which is complementary relative to the support face of the fitting, and is configured on one of said surfaces on the tool ring, and means for clamping the fitting on the tool ring, and wherein the tool has at least one clamp face which is opposite the support face, and wherein the means for clamping the fitting on the tool ring comprise a first element configured for abutment on the clamp face of the fitting, and a second element configured for extending from the clamp face and past the support face, and for engaging with a part of the tool ring intended therefor.

13. A tool ring according to claim 12, characterized in that the support face on the fitting and the complementary support face on the tool ring is configured such that, following mounting of the fitting on the tool ring, the fitting extends completely outside the surface on the tool ring on which the fitting is mounted.

14. A tool ring according to claim 12, characterized in that the tool ring and the fitting have complementary guide faces that ensure correct positioning of the fitting when being mounted on the tool ring.

15. A tool ring according to claim 12, characterized in that mounting apertures are configured at the complementary support faces of the tool ring, said mounting apertures being configured with a view to the introduction of a machine bolt for clamping the fitting on the tool ring; and wherein the mounting aperture extends substantially perpendicular to the complementary support face on the tool ring.

* * * * *

UNITED STATES PATENT AND TRADEMARK OFFICE

CERTIFICATE OF CORRECTION

PATENT NO. : 6,508,715 B1
DATED : January 21, 2003
INVENTOR(S) : Jørn Boie Jensen It is certified that error appears in the above-identified patent and that said Letters Patent is hereby corrected as shown below:

Title page,
Item [75], "Jøn" should read -- Jørn --.

Signed and Sealed this

Sixth Day of May, 2003

JAMES E. ROGAN
*Director of the United States Patent and Trademark Office*